US005205457A

United States Patent [19]

Blomquist, Jr.

[11] Patent Number: 5,205,457

[45] Date of Patent: Apr. 27, 1993

[54] DRIVING TOOL AND METHOD

[76] Inventor: Roy A. Blomquist, Jr., 1725 Arredondo Grant Rd., De Leon Springs, Fla. 32130

[21] Appl. No.: 817,148

[22] Filed: Jan. 6, 1992

[51] Int. Cl.[5] ..... B25C 1/04

[52] U.S. Cl. ..... 227/66; 227/130; 227/139

[58] Field of Search ..... 227/64, 66, 130, 139

[56] References Cited

U.S. PATENT DOCUMENTS

| | | | |
|---|---|---|---|
| 3,027,560 | 4/1962 | Nelson | 227/66 |
| 3,040,324 | 6/1962 | Michel | 227/66 |
| 3,774,293 | 11/1973 | Golsch | 227/66 |
| 4,566,619 | 1/1986 | Kleinholz | 227/66 |
| 4,867,366 | 9/1987 | Kleinholz | 227/66 |

*Primary Examiner*—Frank T. Yost
*Assistant Examiner*—Scott A. Smith
*Attorney, Agent, or Firm*—Allen, Dyer, Doppelt, Franjola & Milbrath

[57] ABSTRACT

A driving tool and method for injecting fasteners such as nails, or the like into workpieces such as drywall, ceilings or wood for framing a building. The driving tool includes a piston coupled to a rod that is driven forward to engage a head of a nail within a chamber of a barrel and drive the nail out the tool through a nozzle. The tool has a resilient member that is impacted on one end by a piston engaging with the nail to slow the piston's and rod's forward velocity. The resilient member is attached at its other end to a rigid member which is coupled to an indentor. The rigid member stops the forward velocity of the piston head and piston rod to limit the penetration of the nailhead into the drywall while placing an indention in the wall with an indentor. The nozzle is shaped to contact the shank of the fastener as the nail is driven through the tool's chamber to ensure that the nail is maintained perpendicular to the surface of the drywall as the nail exits the tool.

8 Claims, 4 Drawing Sheets 24
36
30
35
28
32
34
18
38
16
26
50
14
22
11
10
20
48
40
60
5
5
6
6
42
64
96
44
98
54
46
56
69
94
99
70
82
7
102
7
81
80
74
78
118
116
76
114
86
122
84
104
124
12
126
108
90
92
88
102
72
58
110
9
100
106
9
112

56
50
64
68
68
66
42

DRIVING TOOL AND METHOD

BACKGROUND OF THE INVENTION

This invention relates to a method and apparatus for driving a fastener into a workpiece such as drywall, ceiling or the like for framing a building. More particularly, this invention relates to driving a fastener into a workpiece with a power tool at a high velocity without damaging the workpiece.

Pneumatic fastener driving tools have been widely used in the building industry to join workpieces to other structural components. These tools typically employ a piston-type drive mechanism, which during its driving stroke, engages one of a series of fasteners fed to the tool to force the fastener into the workpiece to be joined.

Many devices have been constructed using these tools, in particular pneumatic-type, to secure drywall to framing studs in constructing walls or ceilings. This drywall and framing stud combination is generally referred to as a workpiece. To construct these walls, four main criteria must be met so that the wall will comply with local building codes. First, the head of the fastener must be recessed in the drywall to a predetermined amount. Second, each drywall sheet must be held firmly to the framing studs. Third, it is preferable that the drywall be slightly indented around the recessed fastener so that the fastener's head may be later concealed with various known sealing compounds deposited in and around each of the indentations. Fourth, the nail must be inserted into the drywall without any damage, such as ripping or tearing, to the paper on the surface of the drywall.

Several pneumatic tools have been proposed to perform these some of these functions in a single operation. Examples of tools for performing some of the aforementioned techniques are disclosed in U.S. Pat. Nos. 2,918,675, 3,774,293, 4,566,619, 4,778,094 and 3,040,327. However, many of the prior art tools have not satisfactorily accomplished these multiple functions. The main reasons for the failure of these pneumatic tools to satisfactorily drive and recess a fastener, while indenting the drywall without ripping or tearing the paper surface of the drywall, is due to the fastener being forced into the drywall at an angle less than 90° relative to the surface of the drywall. Other causes of ripping or tearing are due to the head of the fastener penetrating the surface of the drywall by too great of an amount.

Tools have been designed in a manner which attempts to limit the penetration of the fastener's head into the drywall with a resilient member that slows down the force of the piston hitting the fastener. See U.S. Pat. Nos. 2,918,675 to Smith, 3,774,293 to Golsch, 4,566,619 to Kleinholz and 4,778,094 to Fishback. The forward movement of the piston in such designs is then completely stopped with metal-to-metal contact between the piston and a portion of a dimpler mechanism. This metal-to-metal contact between the piston and a portion of the dimpling part reduces the durability of the tool and also results in stresses in the tool's metal components, thereby lowering the tool's life expectancy.

There are other types of driving tool designs that use a resilient material to stop the forward velocity of the piston. These tools are susceptible to the fastener penetrating the workpiece by more than a predetermined distance resulting in ripping or tearing of the paper on the surface of the drywall. Specifically, the studs are often made with either very hard wood or very soft wood. When the stud is made with hard wood, the fastener encounters more resistance when penetrating the stud than when the fastener is forced to penetrate soft wood. Consequently, with a hard wood stud a resilient material reduces the velocity of the piston too quickly, resulting in the fastener not being driven all the way into the workpiece. On the other hand, with a soft wood stud, the fastener is driven into the drywall too great of a distance, resulting in a ripping or tearing of the paper on the surface of the drywall.

In addition to the fastener's penetration depth not remaining consistent when forced into drywall, the angle at which the fastener penetrates the workpiece may vary with some designs. If the fastener does not penetrate the workpiece at an angle perpendicular to the surface of the workpiece, a ripping or tearing of the paper surface may also result.

Other prior art devices have been designed in an attempt to drive tacks into fabric or the like at nearly perpendicular angles. Examples of these devices are disclosed in U.S. Pat. Nos. 3,854,648, 4,195,762 and 4,252,260. These patents disclose tack-dispensing nozzle assemblies that have wing portions that are pivotally mounted to a nozzle holder. A tack is projected through a channel in the wing portion and out a forward end of the nozzle. When the tack is driven, a circular tackhead forces apart the wing portion. The circular tackhead is centered on the wing portion to maintain alignment while the tack is being driven into the upholstery. However, the heads of fasteners used with drywall are typically very small. Further, the head may have a non-circular shape resulting in the nailhead not being properly centered with the wing portion and the nail being driven into the wood at skewed angles. When nails are driven into drywall at skewed angles, the paper on the surface of the drywall may rip or tear, requiring removal and replacement of the drywall.

SUMMARY OF THE INVENTION

An objective of this invention is to provide an improved driving tool for injecting fasteners such as screws or nails into a workpiece.

Another objective of the invention is to provide an improved method for driving nails having a head and a shank into drywall.

An additional objective of the invention is to force fasteners with a pneumatic driving device into drywall such that the depth the head of the fastener penetrates does not vary from the surface of the drywall more than a predetermined amount independent of the type of drywall and wall stud being used.

It is also an objective of the invention to drive fasteners having a shank into drywall, such that the shank of the fastener penetrates the drywall at an angle perpendicular to the drywall's surface.

It is also a further objective of this invention to drive fasteners into a workpiece having a layer of paper on its surface so that the surface does not rip or tear while the fastener is inserted.

Another objective of the invention is to construct a nozzle assembly that centers a fastener having a long shank and narrow diameter head, such that the shank remains perpendicular to the drywall's surface when driven into the drywall regardless of the shape of the fastener's head.

These and other objectives are provided with a tool for driving a nail into drywall having a paper surface. The tool includes a housing having an elongated channel and a cylinder disposed therein. The channel has an open end and is adapted to receive nails. The tool also includes means for injecting a nail into the channels, a piston head abutting the sides of the cylinder attached to a piston rod extending away from the piston head and into the channel.

Within the tool a means is provided for moving the piston head, along with the piston rod, forward so that the piston rod drives the nail forward through the channel and out the open end. The tool includes means disposed adjacent the open end for indenting the drywall as the nail is discharged out the end.

A connecting means is coupled to the indenting means and is formed from a rigid member. The connecting means stops the forward velocity of the piston head and transfers the force of the forward velocity of the piston head to the indenting means.

The tool also includes preventing means, formed out of a resilient material, and disposed between the connecting means and the piston head. The preventing means prevents the piston head from contacting the connecting means. The preventing means also reduces the forward force of the piston head by compressing the resilient material between the piston head and the connecting means. The thickness of the resilient material has been selected so that when the piston head compresses the resilient material on each nail discharged, the terminal position of a piston head on one end of the piston rod does not vary more than a predetermined amount from the open end of the channel. This predetermined amount is less than the thickness of the paper on the surface of the drywall so that ripping or tearing of the paper on the drywall's surface is prevented.

The above objectives are also achieved with a nozzle assembly comprising a plurality of wing portions defining a nozzle having interior walls forming a channel. The channel has a conically-shaped top portion tapering into a cylindrically-shaped bottom portion. The bottom portion terminates in a nozzle outlet, and the walls of the bottom portion extend axially along the nozzle for a length selected such that when a fastener having a head and a shank is discharged through the channel, the walls of the bottom portion contact the shank to maintain the shank's orientation parallel to the direction of travel of the fastener. The shank's orientation is maintained as the fastener is discharged through the nozzle outlet and penetrates the workpiece. The conically-shaped top portion is disposed at a distance away from the nozzle outlet such that the shank penetrates the workpiece before the head contacts the walls of the conically-shaped top portion. The wing portions are movable outwardly with respect to each other to permit the fastener to be passed through the nozzle outlet.

In another embodiment, the objectives are obtained with a method of discharging a fastener, having a head and a shank, into a flat-surfaced drywall, having a top layer constructed with paper, by using a pneumatic tool. The method comprises the following steps. The shank and the head of the fastener are projected through a channel disposed within the tool, to an opening at the bottom of the channel and into the drywall. The orientation of the shank of the fastener is maintained substantially perpendicular to the surface of the drywall while the fastener moves through the channel and penetrates into the drywall. The distance the fastener's head penetrates the drywall is less than the thickness of the paper on the drywall's surface to prevent the paper from tearing.

DESCRIPTION OF THE PREFERRED EMBODIMENTS

Figures 1, 5:
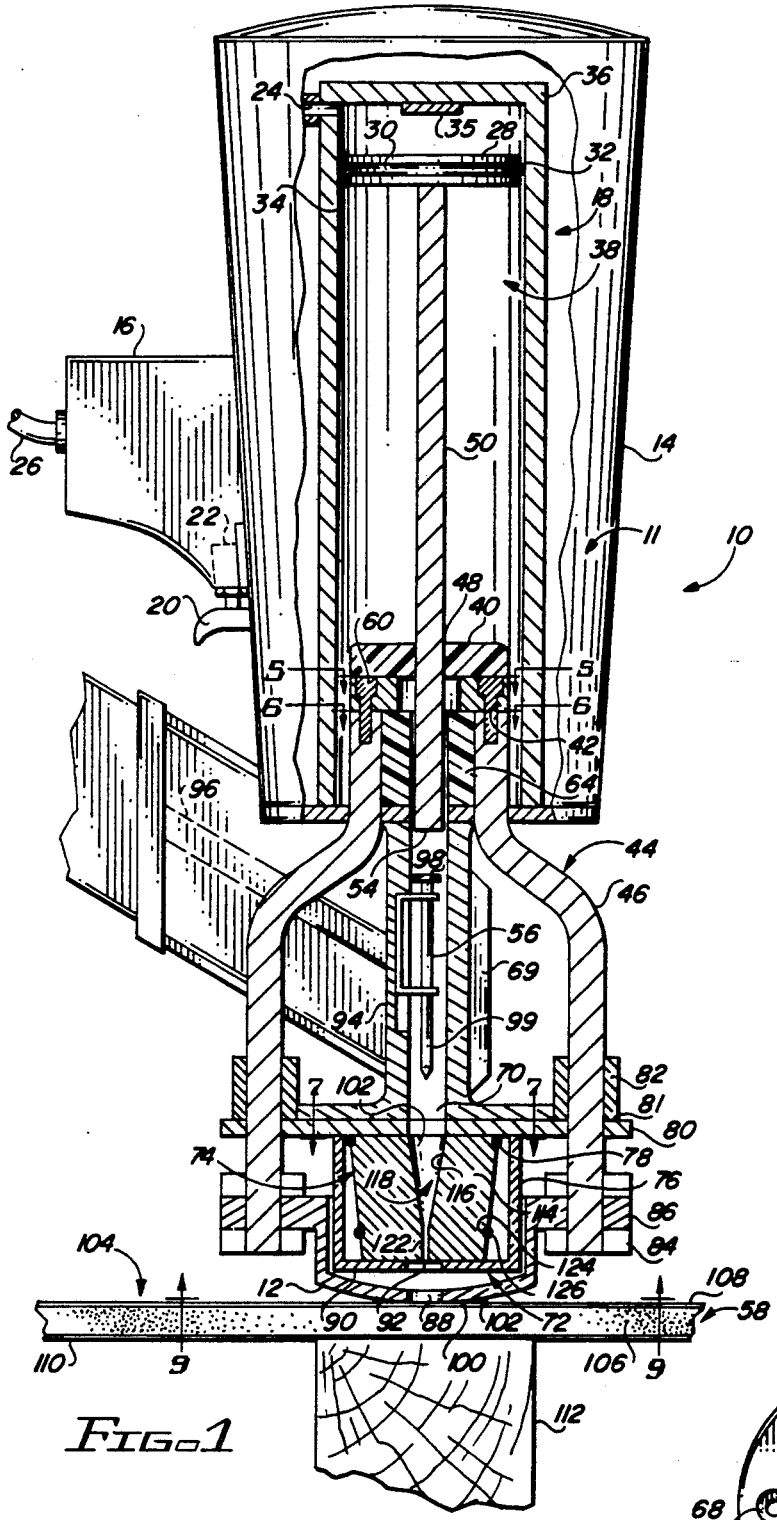
FIG. 1 is a side-sectioned view of the tool incorporating the invention before the driving tool has been activated to force a nail into a drywall.
FIG. 5 is a cross-sectioned view of the impact washer cut along line 5—5 of FIG

Referring to FIG. 1, there is shown a pneumatic driving tool 10 having a nail driving mechanism 11 and a surface indenting or dimpling mechanism 12. Tool 10 includes a housing 14 having a handle 16 formed integrally thereof.

The tool of the present embodiment preferably of pneumatic type having a pneumatic cylinder 18 on or within housing 14 and responsive to the operation of a pneumatic valve assembly 22 actuated by trigger 20 and carried by handle 16. Handle 16 is configured in a conventional pistol grip arrangement. Valve assembly 22 operates to selectively apply pressurized air to an air inlet port 24 in cylinder 18. The air is supplied upon actuation of trigger 20, from pressurized air hose 26 connected to handle 16 and an air compressor (not shown).

Details of various pneumatic designs for valve assembly 22 in various configurations of air passages for the operation of cylinders, such as cylinder 18, are described in U.S. Pat. Nos. 2,918,675 to Smith, 3,434,643 to Wendell, 3,040,327 to Michel, and 3,774,293 to Golsch. The pneumatic designs described in these patents show means for driving and controlling motion of the piston position in a cylinder for causing the piston to reciprocate by advancing in one direction when trigger 20 is depressed and then to return either upon release of trigger 20 or upon completion of the advancing stroke.

A cylindrical pneumatic piston head 28 is slidably mounted in cylinder 18 to reciprocate axially therein. Along the edge of piston head 28 is annular groove 30 in which is fitted a circular O-ring 32 to form a pneumatically tight seal between piston head 28 and walls 34 of cylinder 18. Resilient stop 35 is mounted at the center of cylinder head 36 and is bolted on to the back end of cylinder 18 to form a pneumatically tight seal with wall 34. Disposed in pneumatic cylinder 18 is a piston cavity 38. Across the forward end of cylinder 18 is piston damper 40 adhesively secured to an impact washer 42. Impact washer 42 is rigidly connected to connecting member 44. Connecting member 44 includes a connecting rod 46 and impact washer 42. Extending through piston damper 40 is a circular hole 48 centered on the axis of cylinder 18.

Rigidly secured at the forward end of piston head 28 and extending axially therefrom is piston rod 50. Piston rod 50 is preferably machined of hardened metal into two portions, a rear most portion which includes piston head 28 and a forward portion, referred to as piston rod 50. Piston head 28 has a diameter, substantially the same as the diameter of the inside surface of walls 34. The nominal diameter of hole 48 is concentric with the outer diameter of piston rod 50.

Piston rod 50 extends forward from piston head 28 on an axis extending through the center of cylinder 18. Piston rod 50 terminates at its forward end in flat tip 54. Tip 54 functions as the head of a hammer for driving nails. Although nails are described in this specification, other types of fasteners such as screws or tacks may be substituted for nails. The plane of flat tip 54 is preferably perpendicular to the axis of piston rod 50 and is preferably cylindrical.

Figure 4:
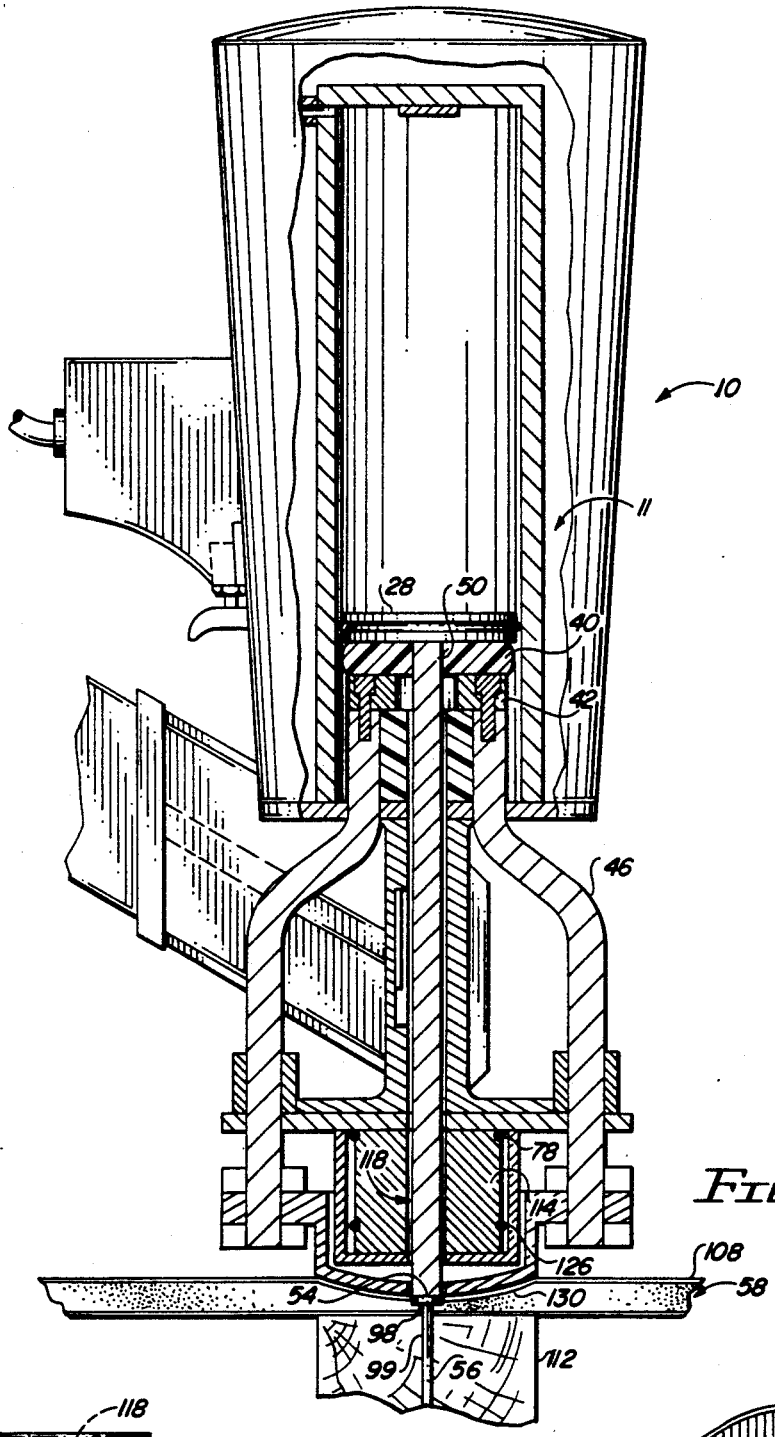
FIG. 4 is a view of the tool incorporating the invention shown in FIG. 1 after the driving tool has reached its terminal position and forced the nail completely into the drywall.

Piston rod 50 moves with piston head 28. Piston head 28 is slidable in cylinder 18 from a retracted position, illustrated in FIG. 1, to a partially extended position, shown in FIG. 2. When piston head 28 slides forward, tip 54 of piston rod 50 moves to contact nail 56. Piston rod 50 moves to an extended position forcing nail 56 to penetrate drywall 58. When piston rod 50 reaches its fully extended position, piston head 28 contacts upper piston damper 40, as shown in FIG. 4. Upper piston damper 40 is molded of an elastomeric or resilient material which surrounds piston rod 50 and hole 48 disposed therein. Upper piston damper 40 is securely fastened to impact washer 42 which is disposed within piston cavity 38 and has an outer perimeter concentric with the outer perimeter of piston damper 40. Impact washer 42 is preferably constructed from a rigid material, such as metal, and is attached with screws 60 to connecting rod 46.

Referring to FIG. 5, impact washer 42 is shown surrounding piston rod 50 within hole 66 having a diameter concentric with the diameter of rod 50. Extending through impact washer 42 are holes 68, for placement of screws 60.

Upper piston damper 40, in conjunction with impact washer 42 and connecting rod 46, limit the forward movement of piston head 28. More specifically, piston damper 40 reduces the forward velocity of piston head 28 when piston head 28 is pneumatically activated. When upper piston damper 40 is fully compressed, the forward velocity of piston head 28 is stopped by impact washer 42, by transferring the forces of head 28 to indenting mechanism 12. The thickness of upper piston damper is preferably ¼-inches to 3/16-inches. This thickness is selected to ensure that upper piston damper 40 is totally compressed on successive piston head activations, regardless of the material of the workpiece in which nail 56 is inserted.

Figure 6:
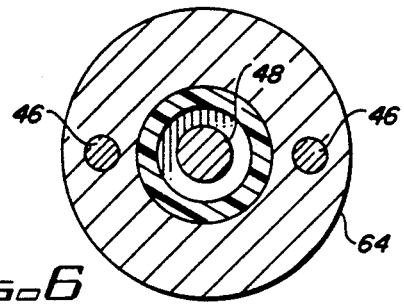
FIG. 6 is a cross-sectioned view of the lower piston damper cut along line 6—6 of FIG. 1.

As illustrated further in FIG. 1 and FIG. 6, impact washer 42 is coupled to connecting rod 46 and lower piston damper 64. Lower piston damper 64 reduces shock to handle 16 and housing 14 when piston head 28 is stopped by impact washer 42. Lower piston damper 64 is preferably constructed from a resilient material and is attached to forward end of housing 14.

Figure 2:
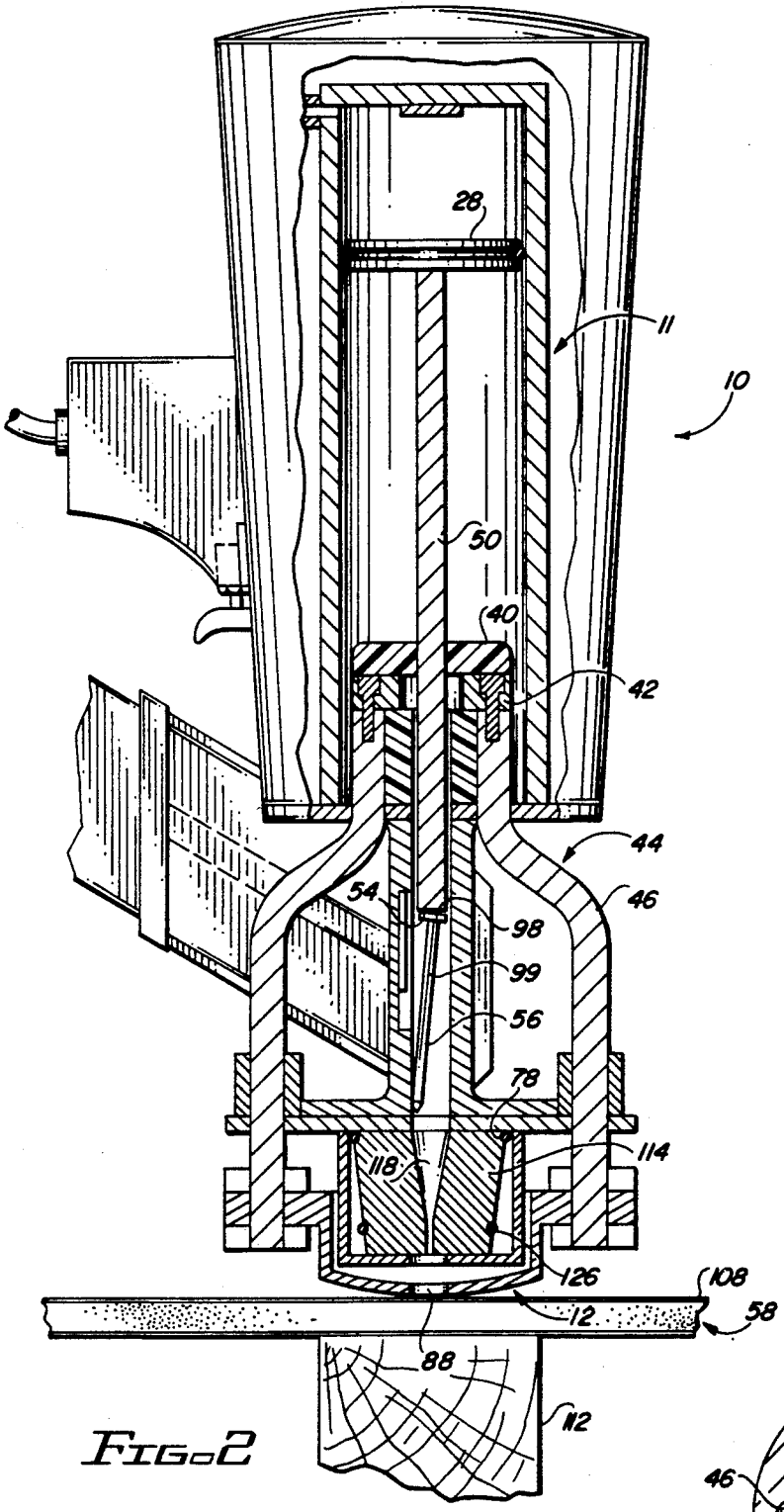
FIG. 2 is a side-sectioned view of the tool incorporating the invention shown in FIG. 1 after the driving tool is initially activated and the piston rod first contacts a nail.

Referring to FIG. 2, rigidly secured to connecting rod 46 and extending longitudinally therefrom is barrel 69 having chamber 70 disposed therein for receiving nail 56. Chamber 70 is concentric with, and of the same nominal diameter, as holes 48 and 66.

Located at the bottom of chamber 70 is housing 76 enclosing nozzle assembly 74. Nozzle assembly 74 is coupled to housing 76 of chamber 72 with steel ring 78. Housing 76 is coupled to connecting steel plate 80, which is attached to bushing 94. Steel plate 80 is welded to barrel 69. Bushings 82 are fixedly attached to plate 80. Connecting rod 46 slides through bushing 82. It is recognized by the applicant that the comparison of piston damper 64 determines the movement of washer 42, rod 46, plate 86 and mechanism 12.

Steel plate 86 is attached to the forward end of connecting rod 46 through adjustable nuts 84. Adjustable nuts 84, when formed, change the terminal position of tip 54 with respect to orifice 92. Steel plates 86 are disposed around the outer diameter of housing 76 and are coupled to dimpler mechanism 12. At the inner diameter of dimpler 12 on the forward end of chamber 69 is a circular orifice 92 generally referred to as an open end. Circular orifice 92 has a diameter substantially concentric with that of piston rod 50. Disposed at the bottom end of chamber 72 is plate 90, which is coupled on its perimeter to housing 76. Plate 90 also has a circular orifice, generally referred to as circular orifice 92. The diameter of circular orifice 92 is preferably concentric with the outer diameter of piston rod 50.

Chamber 70 has adjacent side wall of barrel 69, a rectangular opening 94 through which fasteners, in this case nails 56, are fed one at a time from magazine 96 into the center of chamber 70 immediately forward of tip 54. Nails 56 are fed from magazine 96 into chamber 70 by a feeder mechanism (not shown). When so fed, the upper edges of nailheads 98 are directed against the edge of chamber 70 and positioned in the path of tip 54.

Designs for magazines and feeder mechanisms are conventional, several types which are suitably adapted to tools embodying the present invention being described and patented in the prior art. Such mechanisms and feeders are useful in tools which comprise nail-driving and dimpling apparatuses as described, for example, in U.S. Pat. Nos. 3,774,293 to Golsch, 4,566,614 to Kleinholz and 4,610,381 to Kramer. These mechanisms operate to sequentially feed individual nails or strips of nails joined by separate web from a linear magazine through an opening in the side of the barrel and into the barrel bore. These, and other similar mechanisms described in these patents, or those cited therein, are adaptable by those skilled in the art to operate within the apparatus of the present invention.

The illustrated embodiment of the present invention preferably employs a conventional magazine 96 having a flexible belt of nails and feeder mechanism. The nail strips for magazine 96 are formed of a series of nails joined by a flexible, separable plastic or paper web to which they are attached.

Indenting mechanism 12 is preferably constructed of a hardened metal and has a round head 100 with a slightly concave, outer indenting surface 102. Indenting mechanism 12 has a cylindrical body having a nominal diameter less than the diameter on the outer perimeter of housing 14.

Nail driving and surface indenting mechanism 12 comprises primary piston rod 50, barrel 69, outer indenting surface 102 and the related components and accessory parts as described above. The function of this mechanism 12 is to drive nail 56, which has been fed by feeder from magazine 96, through drywall 104 into stud 112. Drywall 104 is illustrated in the FIGs as a sheet of plaster 106 placed between two sheets of paper covering 108 and 110. Nails 56 are driven to secure drywall 104 to framing members, such as wood studs 12, in house and office construction. The operation and other structural details of tool 10 which embodies the invention can be understood by reference to FIGS. 1 through 4.

Figure 7:
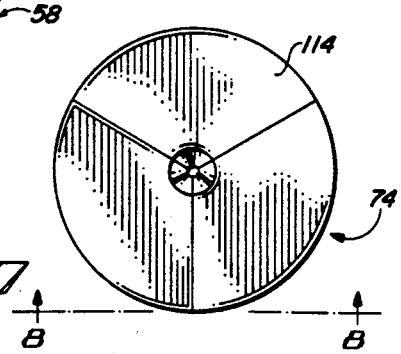
FIG. 7 is a cross-sectioned view of the nozzle assembly cut along line 7—7 of FIG. 1.
Figure 8:
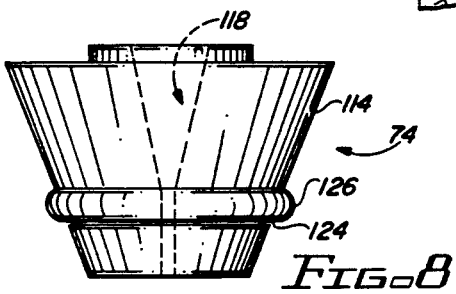
FIG. 8 is a side view of the nozzle cut along line 8—8 of FIG. 7.
Figure 9:
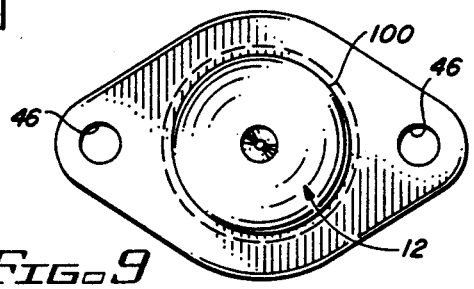
FIG. 9 is a bottom view of the indenter along line 9—9 of FIG.

Referring to FIGS. 1, 7 and 8, nozzle assembly 74 includes a plurality of wing portions 114 having a circular outer perimeter and cross section. Wing portions 114 have interior walls 116 which form a fastener guide channel 118. This fastener guide channel 118 has a conically shaped top portion 120 which tapers into a cylindrically shaped bottom portion 122. Wing portions 114 have a groove 124 which extends around the perimeter of outside surface of wing portions 114 and is adapted for receiving O-ring 126. O-ring 126 is preferably constructed with an elastic resilient material which allows wing portions 114 to pivot outward about steel ring 78 when nail 56 is forced through channel 118 and out circular orifice 92. Steel ring 78 is disposed around the top edge of the outer perimeter of top portion 120 and holds rear edge of nozzle assembly 74 in place during operation. Referring to FIG. 2, during operation piston rod 50 contacts nailhead 98 and pushes nail 56 toward channel 118. Nail 56 contacts wall 114. Wall 114 forces shank 99 of nail 56 to become centered about the axis extending through channel 70 and channel 118.

Figure 3:
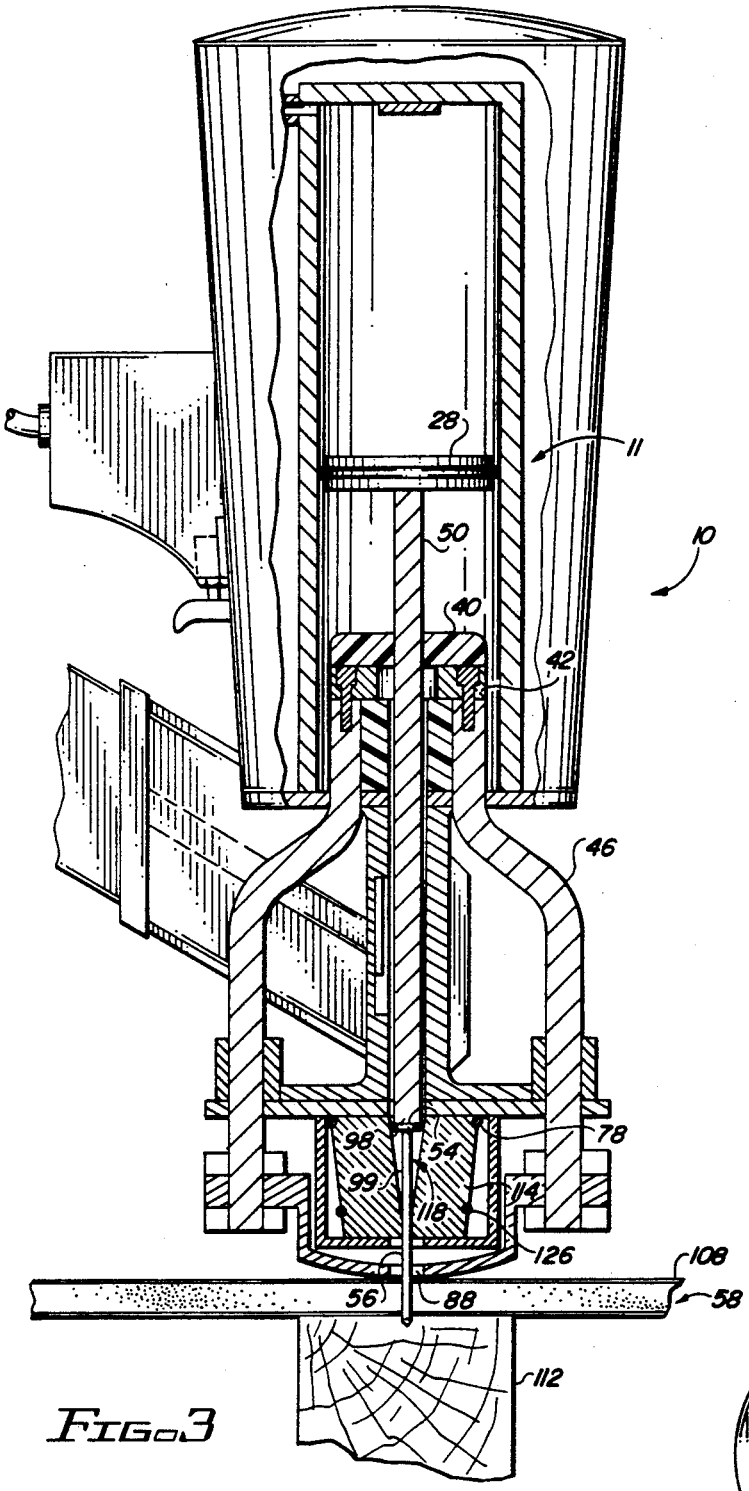
FIG. 3 is a side view of the tool incorporating the invention shown in FIG. 1 after the driving tool has initially forced the nail into the drywall.

Referring to FIG. 3, as the piston rod 50 continues its forward progress, shank 99 of nail 56 is centered by inner walls of wing portions 114. Shank 99 is then forced by walls on bottom portion 122 into an orientation perpendicular to the surface of drywall 58. It is recognized that shank 99 contacts wing portions 114 of nozzle assembly 74 before nailhead 98 contacts wing portions 114. Accordingly, the orientation of nail 56 is maintained perpendicular to surface of drywall 58 by nozzle assembly 74 irrespective of the shape of nailhead 98. As piston rod 50 continues to move forward, tip 54 of nail 56 penetrates drywall 58 and stud 112.

Referring to FIG. 4, as piston rod 50 continues to drive nail 56 into drywall 58, wing portion 114 flexes outward away along its forward edge from an axis extending through the center of the channel 118. The rearward edge of wing portion 114 is held in place by steel ring 78. As piston head 28 is ejected forward, damper 40 reduces the forward velocity of piston head 28. Further, impact washer 42 stops the forward velocity of piston head 28 and transfers the force of piston head 28 through connecting rod 46 to indenting mechanism 12. Indenting mechanism 12 then transfers this force to drywall 58 resulting in an indentation 130.

As damper 40 reaches full compression on each successive release of nail 56 through circular orifice 92, the depth of indentation 130 varies from release to release. However, any variations in the distance between the terminal point of tip 54 circular orifice 92 remains small. Further, by selecting the thickness of impact washer 42 to be between 3/16 and ¼-inches and maintains a force of 100 pounds per square inch on piston head 28 during activation. The distance variation of the terminal position of piston rod 50 remains less than the thickness of paper covering 108, typically 0.025 inches.

Shank 99 is inserted through drywall 58 and into stud 112 at an angle perpendicular to the surface of drywall 58. The terminal position of nailhead 98 is restricted to not exceed the thickness of paper covering 108. As a result of this angle being maintained and the terminal position of nailhead 98 being restricted, the paper covering is prevented from tearing or ripping when nail 56 is driven into drywall 58 and stud 112.

This concludes the description of the preferred embodiments. A reading by those skilled in the art will bring to mind various changes without departing from the spirit and scope of the invention. It is intended, however, that the invention only be limited by the following appended claims.

What is claimed is:

1. A tool for driving a fastener into drywall having a paper layer or the like formed on the drywall surface, the tool comprising:

a housing enclosing a cylinder;

a barrel being coupled to said housing;

said barrel having an open end and being adapted to receive fasteners;

means for placing a fastener in the barrel;

a piston head abutting the sides of said cylinder, said piston head being attached to a piston rod extending away from said piston head and into said barrel;

means for forcing the piston head forward in said cylinder from an initial position to a terminal position, said piston rod moving with the piston head forward to contact the fasteners within said barrel such that said fasteners are pushed, forward through the barrel by the rod and out an open end of said barrel;

means disposed adjacent the open end of said barrel for indenting said drywall as said fastener is discharged out the open end of said barrel;

connecting means disposed along opposite sides of said barrel coupled to said indenting means and being formed from a rigid material, for stopping the forward velocity of said piston head and transferring the force of said forward velocity of said piston head to said indenting means;

means disposed between said connecting means and said piston head and being formed of a resilient material for preventing said piston head from contacting said connecting means and for reducing the forward velocity of said piston head, said resilient material being compressed between said piston head and said connecting means when said piston head forward velocity is reduced, said resilient material having a thickness selected such that when compressed on successive fastener dischargings, the terminal position of one end of the piston rod will not vary more than a predetermined amount from an open end of the indenting means, the predetermined amount having a dimension less than the thickness of paper formed on the surface of the drywall.

2. The tool as recited in claim 1 further comprising means for adjusting the location of the terminal position of the end of the piston rod with respect to the open end of the indenting means.

3. The tool as recited in claim 1 wherein said forcing means is pneumatically activated by a trigger.

4. The tool as recited in claim 1 wherein said connecting means includes an impact washer coupled to connecting rods and coupled to an indentor such that the force is transferred from said impact washer to said connecting rod while said piston head's forward velocity is being stopped.

5. The tool as recited in claim 4 further comprising a lower piston damper constructed with resilient material coupled between said impact washer and a forward portion of said housing.

6. A tool for driving a nail into drywall, the tool comprising:

a housing enclosing a cylinder and having a handle;

a barrel being coupled to said housing and enclosing a chamber;

a means for placing nails into said chamber;

a piston head disposed within said cylinder, said piston head being connected to a piston rod that extends from said cylinder into said chamber, and moves with said piston head;

means for enabling air to be forced into said cylinder and drive said piston head forward such that said piston rod contacts said nail to drive said nail out of said chamber and into the drywall;

a dimpling mechanism disposed adjacent one end of said barrel for indenting said drywall when said fastener is driven into said drywall;

a plurality of connecting rods disposed along opposite sides of said barrel, said rods being coupled to said dimpling mechanism and said housing for stopping the forward velocity of said piston head and transferring the force of said forward velocity of said piston head to said dimpling mechanism;

damper means for preventing said piston head from contacting said connecting rods and for reducing the forward velocity of said piston head, said damper means including a piston damper being formed with a resilient material and being disposed between said piston head and one end of said connecting rods, said damper being compressed when said forward velocity of said piston head is reduced, said damper having a hole about its center for insertion of said piston rod;

means for maintaining said barrel centered on said connecting rods comprising a steel plate coupled to said barrel and having an aperture disposed adjacent each plate end in which said connecting rods are inserted;

means for guiding said nail as said nail exits said chamber and enters said drywall comprising a nozzle assembly disposed adjacent the forward end of said barrel.

7. The tool as recited in claim 6 further comprising an impact washer surrounding said piston rod and being disposed between said piston damper and said connecting rod.

8. The tool as recited in claim 7 further comprising a lower piston damper disposed between said impact washer and a forward edge of said housing, said lower piston damper extending around said piston rod and being disposed between said piston rod and said connecting rods.

* * * * *